US011155928B2

(12) United States Patent
Matzdorf et al.

(10) Patent No.: US 11,155,928 B2
(45) Date of Patent: Oct. 26, 2021

(54) ELECTROLYTIC PROCESS FOR DEPOSITION OF CHEMICAL CONVERSION COATINGS

(71) Applicants: Craig Matzdorf, Hollywood, MD (US); Alan Grieve, Springfield, VA (US); Alexander Westbrook, Lexington Park, MD (US); Jeremy Mattison, California, MD (US)

(72) Inventors: Craig Matzdorf, Hollywood, MD (US); Alan Grieve, Springfield, VA (US); Alexander Westbrook, Lexington Park, MD (US); Jeremy Mattison, California, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 97 days.

(21) Appl. No.: 16/720,483

(22) Filed: Dec. 19, 2019

(65) Prior Publication Data

US 2021/0189580 A1 Jun. 24, 2021

(51) Int. Cl.
*C25D 3/06* (2006.01)
*C25D 7/06* (2006.01)

(52) U.S. Cl.
CPC ..... *C25D 3/06* (2013.01); *C25D 7/0642* (2013.01)

(58) Field of Classification Search
None
See application file for complete search history.

(56) References Cited

U.S. PATENT DOCUMENTS

| | | | | |
|---|---|---|---|---|
| 1,977,622 | A | 10/1934 | Buzzard | |
| 6,511,532 | B2 * | 1/2003 | Matzdorf | C09D 5/084 106/14.21 |
| 8,187,439 | B2 | 5/2012 | Wang et al. | |
| 9,309,602 | B2 | 4/2016 | Wolpers et al. | |
| 10,156,016 | B2 | 12/2018 | Kramer et al. | |
| 10,274,468 | B2 | 4/2019 | Wolfgong et al. | |
| 2006/0191599 | A1 | 8/2006 | Matzdorf et al. | |
| 2019/0352791 | A1 | 11/2019 | Ozkaya et al. | |

FOREIGN PATENT DOCUMENTS

| | | |
|---|---|---|
| WO | WO 1998/040542 A1 | 9/1998 |
| WO | PCT/US20/18946 | 6/2021 |

* cited by examiner

*Primary Examiner* — Wojciech Haske
(74) *Attorney, Agent, or Firm* — Mark O. Glut; NAWCAD

(57) ABSTRACT

This invention is directed to a process of coating metal in a trivalent chromium conversion-electrolyte coating wherein the metal anode or cathode is subjected to a current density ranging up to about 3.0 amperes per square foot for a period ranging up to 60 minutes.

4 Claims, 8 Drawing Sheets

ELECTROLYTIC PROCESS FOR DEPOSITION OF CHEMICAL CONVERSION COATINGS

ORIGIN OF INVENTION

The invention described herein was made by employee(s) of the United States Government and may be manufactured and used by or for the Government for governmental purposes without the payment of any royalties thereon or therefor.

FIELD OF THE INVENTION

The invention relates to a novel electrolytic process to control the deposition of chemical conversion coatings on metal substrates. The process could be adjusted for different coating-substrate to achieve optimal coating formation and corrosion prevention. The process could be used in immersion applications, or made portable by a handheld device. The process involves the passage of current through a conversion coating electrolyte in which the work surface is either the cathode or anode. The cathodic or anodic current density is equal to or less than 3.0 $^{A}/_{FT}{}^{2}$, (3.0 amperes per square foot) and the immersion time is equal to or less than 60 minutes. A novel feature of this invention is the application of electric current to the metal work surface during the coating formation. Prior art demonstrates diffusion-controlled coating growth, whereas the electrolytic process alters the reaction kinetics to promote faster coating growth. The electrodeposited coatings afford superior corrosion resistance and improved coating thicknesses compared to coatings prepared using traditional diffusion-controlled processes. The coatings produced with impressed current do not worsen paint adhesion, as determined by ASTM D3359 testing. The process produces trivalent chromium (Cr(III))-containing conversion coatings that exhibit equal corrosion performance to hexavalent chromium (Cr (VI))-containing conversion coatings without the health and environmental risks associated with the use of Cr(VI) chemistry. The process similarly improves the corrosion performance of hexavalent chromium and non-chromium conversion coatings.

More specifically, the use of chromate conversion coatings on aircraft aluminum alloys is the need for excellent corrosion resistance and to serve as a base for paint. Baths used to develop these coatings contain hexavalent chromium, and residual chromates in the coating are largely responsible for the high degree of corrosion inhibition. These same chromates are hazardous and their presence in waste water is severely restricted. It would be desirable to provide a coating for aluminum and its alloys, utilizing trivalent chromium as an alternative to the hexavalent chromates. Trivalent chromium has been used in conversion coatings instead of hexavalent chromium to produce replacements for hexavalent chromium-containing coatings.

BACKGROUND OF INVENTION

The development of chromate ($CrO_4$) conversion coatings (known commercially by names such as (Alodine, Iridite or Chromital) for the corrosion protection of high-strength, aerospace aluminum alloys occurred between 1945 and the 1950's. In the United States, these coatings are qualified to MIL-DTL-81706 for military use, while MIL-DTL-5541 provides guidance for the quality control of these processes. An effort to eliminate hexavalent chromium resulted in the development and optimization of trivalent chromium (Cr (III)) conversion coatings in the early 2000's. The Cr(III) coatings are also qualified to the MIL-DTL-81706 specification, though their adoption is limited by their lesser corrosion performance and a near-colorless appearance.

Currently available non-chromium conversion coatings fail to meet MIL-DTL-5541 requirements. Although the Cr(III) conversion coatings offer numerous advantages over the legacy Cr(VI) products, the absence of the chromate anion in the Cr(III) coatings reduces the pitting resistance in ASTM B117 neutral salt fog exposure for a duration of at least two weeks. Some of the current commercial Cr(III) coatings can meet the minimum two-week requirement, albeit with greater difficulty. Given the known health hazards of chromate conversion coatings, there is a strong desire to develop an alternative, safer process that affords similar levels of protection against localized corrosion. Therefore, it is desirable to have coatings that are free of hexavalent chromium, but capable of imparting corrosion resistance and paint bonding which are comparable to hexavalent chromium coatings.

DESCRIPTION OF INVENTION

Figure 1:
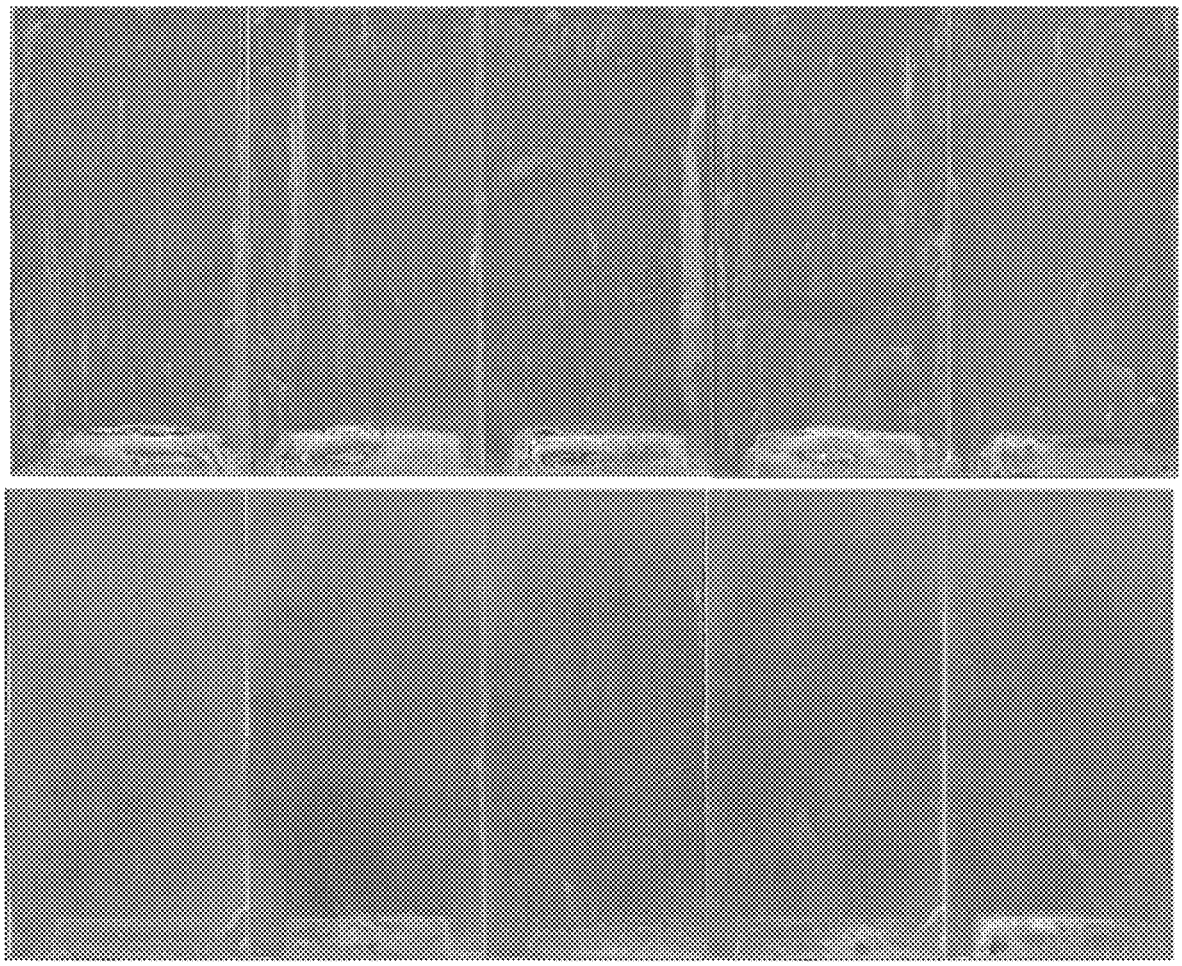
FIG. 1 shows the performance of the invention (bottom row of panels) compared the control (top row of panels), without impressed current after 4 weeks of exposure in ASTM B117 salt fog. The test panels are AA2024-T3 aluminum. The controls were treated in Surtec 650 for five minutes. The invention was also treated in Surtec 650 for five minutes, but also had 0-3 amps per square foot current applied, with the AA2024-T3 panels as the cathode. The anode was AA1100 aluminum panels.

The invention is directed to a process wherein an electric current is passed through a conversion-coating electrolyte at a cathodic or anodic current density not exceeding 3 amperes per square foot ($^{A}/_{ft}^{2}$) for a duration equal to or less than 60 minutes. The conversion coating electrodeposits at the cathodic or anodic metal surface, while oxygen or hydrogen are evolved at the counter electrodes.

More specifically, prior to processing, the test panels are affixed to a rack made of suitable, conductive material. A bus bar made from suitable, conductive material is suspended over the chemical conversion coating tank. Two or more counter electrodes are attached to the bus bar, such that the counter electrodes are immersed in the solution, no more than 1 foot from the work surfaces. The counter electrodes are immersed at a depth that is more shallow than the parts to avoid high current density areas on the parts. The bus bar is electrically connected to the rectifier to impart the desired polarity to the counter electrodes, either cathodic or anodic.

Once the parts are cleaned and deoxidized, the rack is immersed in the conversion coating solution. Next, the rack is electrically connected to the rectifier so that the rack is the opposite polarity of the counter electrodes. The rectifier is then powered for the full duration of the conversion coating process. At the conclusion of the conversion coating immersion, the rectifier is powered down, and the rack is disconnected from the rectifier and removed from the conversion coating solution. Alternatively, the rack and bus bar may be electrically connected to the rectifier, and the rectifier powered prior to the immersion of the rack in the conversion coating solution. Similarly, the rack may be removed at the conclusion of the conversion coating process while the rectifier is still on. Entering and exiting the solution while "hot" describes this process.

Several 3"×6"×0.025" (AA2024-T3) test panels were procured from Q-Lab Corporation, cleaned with ASTM-D329 acetone, and placed on a titanium alloy rack. The panels were immersed in BONDERITE C-AK 6849 AERO, an alkaline, non-etch, non-silicate cleaner until a water-break-free surface was achieved in a 120-140° rinse water bath. The test panels were then immersed in BONDERITE C-IC SmutGo AERO ACID, a non-chromium deoxidizer for one minute. The racked test panels were immersed in SurTec 650 conversion coating solution. A suitable DC power supply was connected to the titanium alloy rack and two 1000-series aluminum counter electrodes. The power supply was then operated in a constant-current mode to provide a cathodic or anodic current density not exceeding 3.0 $^{A}/_{ft}^{2}$. The duration of coating formation was equal to or less than 60 minutes, at which point the power supply was turned off, and the test panels were removed from the conversion coating solution.

Trials in which the panels were immersed and removed from the chemical conversion coating while the power supply was on were also conducted. The test panels were rinsed with deionized water, and then air-dried. Two panels were set aside from each experimental condition for coating weight determination and analysis using electrochemical impedance spectroscopy (EIS).

Coating performance was evaluated with a comparative analysis of ASTM B117 neutral salt fog exposure results. Control panels were processed under diffusion-controlled conditions without the electrolytic process, while the experimental panels were processed with the passage of current through the conversion coating electrolyte. Both the experimental and the control test panels were allowed to air dry for at least 24 hours (at approximately 77F and 40% RH) in order to allow the coatings to dehydrate before neutral salt fog exposure. All test panels were placed in the same neutral salt fog test cabinet to minimize variation associated with the method. During neutral salt fog exposure, the test panels were removed, imaged, analyzed, and returned to the same test chamber at one week intervals until the experimental panels displayed extensive localized corrosion.

Performance Data

FIGS. 1 through 9 contain images of 5 replicate panels after exposure to ASTM B117 neutral salt fog. The top five panels are the "control" panels (without impressed current), and the bottom five panels are the experimental panels (with impressed current). It is clear that the impressed current process improves the corrosion resistance of the experimental panels. Furthermore, the examples below demonstrate the effectiveness of the process on multiple alloys, in repair-type conditions, and in dye-enhanced solutions.

Tables 1 through 6 and 8 contain coating weight measurements ($^{mg}/_{ft}^{2}$) for control (without impressed current) and experimental (with impressed cathodic or anodic current) panels. Control conditions are italicized. It is clear that the impressed current increases the mass of the deposited conversion coating (coating weight). Furthermore, the results below demonstrate the process's ability to improve conversion coating weight on multiple alloys, and with two different conversion coating solutions (Cr(III)-containing and Cr-free).

Example 1

Purpose: To directly compare the performance of a trivalent chromium conversion coating with and without impressed current. FIG. 1 shows four-week ASTM B117 corrosion results for a diffusion-controlled (top, control) versus electrodeposited (bottom, experimental) SurTec 650 trivalent chromium conversion coating. The impressed current process outperforms the control process by a large margin. Panels processed 16 Feb. 2018.

TABLE 1

| Date | Current (ASF) | Polarity | Coating Weight (mg/s · ft) |
|---|---|---|---|
| 16 Feb. 2018 | 0 | | 24.8 |
| 16 Feb. 2018 | 0-3 | Cathodic | 52.8 |

TABLE 1-continued

| Date | Current (ASF) | Polarity | Coating Weight (mg/s · ft) |
|---|---|---|---|
| 16 Feb. 2018 | 0-3 | Cathodic | 38 |
| 16 Feb. 2018 | 0-3 | Cathodic | 32 |

Table 1 shows the effect of cathodic impressed current in a Cr(III) conversion coating solution on the coating weight. The coating weight at 0-3 ASF applied current is up to 112% greater than the control (AA2024-T3).

Example 2

Figure 2:
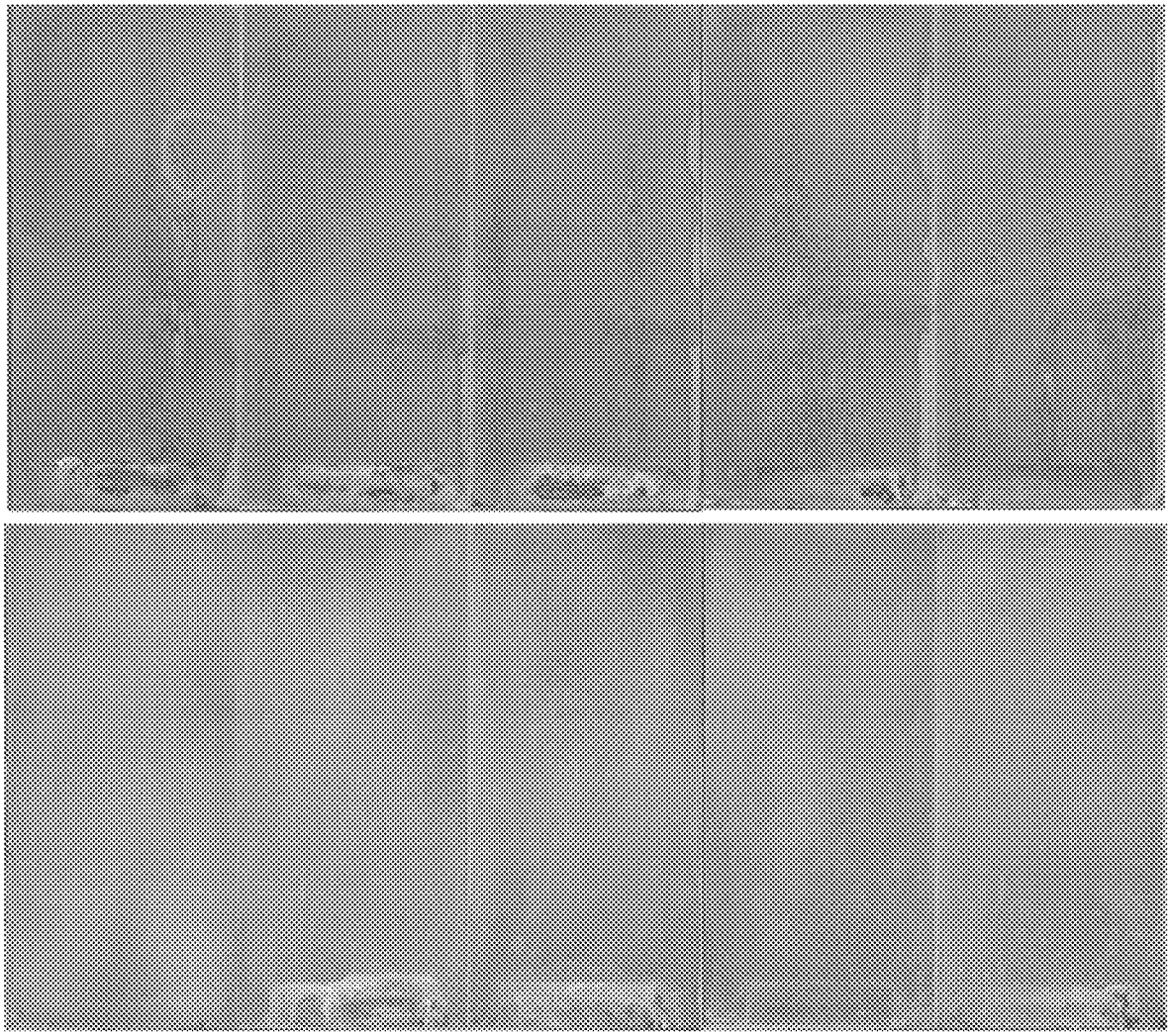
FIG. 2 shows panels treated identically to those in FIG. 1, except that instead of a chemical deoxidation, the panels were hand abraded with a Scotch-Brite pad, #7447, to simulate a field repair.

Purpose: To examine the electrodeposited trivalent chromium conversion coating on a "repaired" surface. FIG. 2 shows two-week ASTM B117 corrosion results for a diffusion-controlled (top, control) versus electrodeposited (bottom, experimental) SurTec 650 trivalent chromium coating. The panels were abraded with Scotchbrite to simulate a reworked surface. The corrosion results indicate that the electrodeposited coating performs much better than the control coating. The panels were processed on 19 Mar. 2018.

TABLE 2

| Date | Current (ASF) | Polarity | Coating Weight (mg/s · ft) |
|---|---|---|---|
| 19 Mar. 2018 | 0 | | 34.4 |
| 19 Mar. 2018 | 0-3 | Cathodic | 53.1 |

Table 2 shows the effect of cathodic impressed current in a Cr(III) conversion coating solution on the coating weight in a repair/depot-type situation. The control and impressed current panels were abraded with ScotchBrite 7447 to simulate rework. The coating weight at 0-3 ASF applied current is 54% greater than the control.

Example 3

Figure 3:
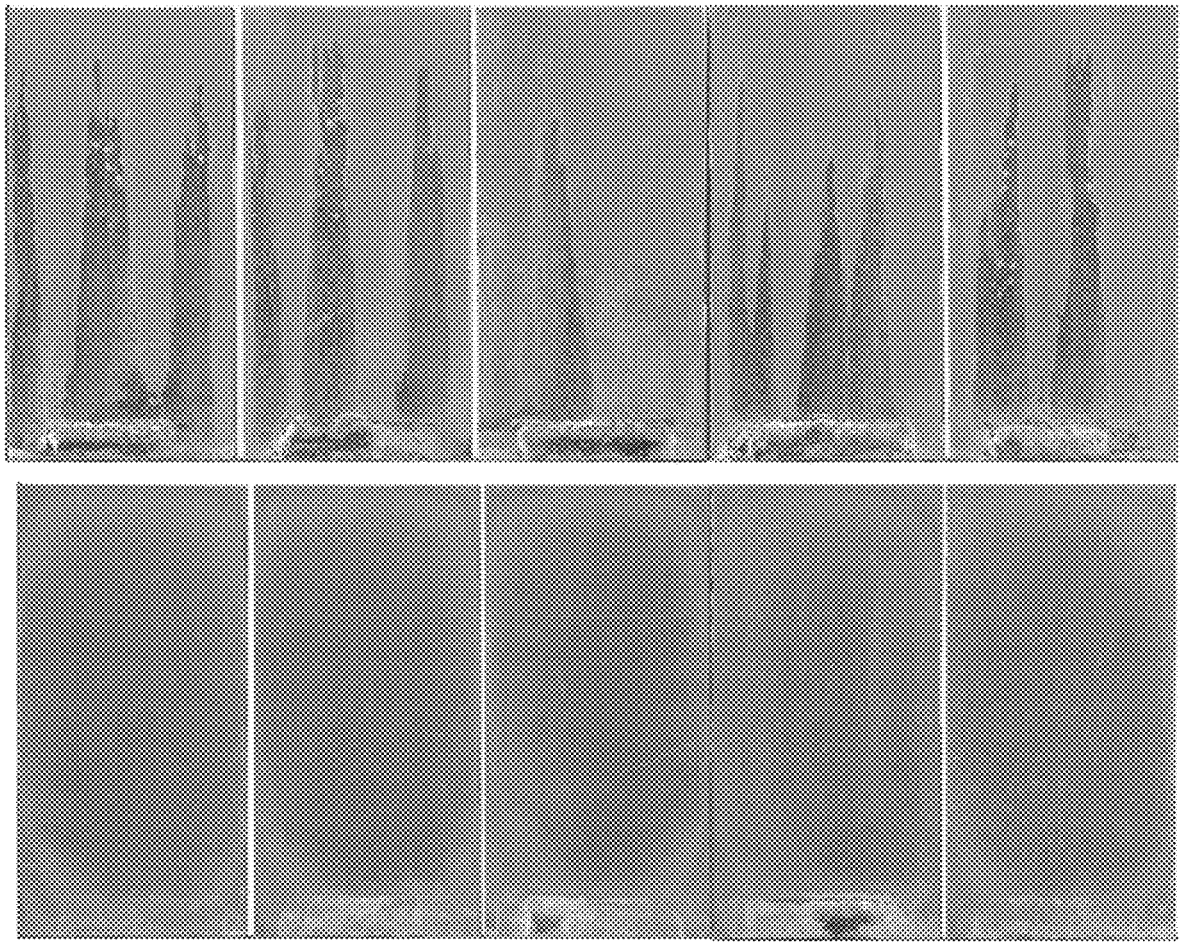
FIG. 3 shows the performance of the invention similar to FIG. 1. The experiment from FIG. 1 was repeated and testing in ASTM B117 extended to 6 weeks.

Purpose: To repeat the direct comparison the performance of a trivalent chromium conversion coating with and without impressed current. FIG. 3 shows six week ASTM B117 corrosion results for a diffusion-controlled (top, control) versus electrodeposited (bottom, experimental) SurTec 650 trivalent chromium conversion coating. It is important to note that six weeks of performance for a trivalent conversion coating has not been achieved prior to this experiment. Panels processed 27 Apr. 2018.

TABLE 3

| Date | Current (ASF) | Polarity | Coating Weight (mg/s · ft) |
|---|---|---|---|
| 27 APR. 2018 | 0 | | 24.9 |
| 27 APR. 2018 | 0-3 | Cathodic | 56.3 |

Table 3 shows the effect of cathodic impressed current in a Cr(III) conversion coating solution on the coating weight. The coating weight at 0-3 ASF applied current is 126% greater than the control (AA2024-T3).

Example 4

Figure 4:
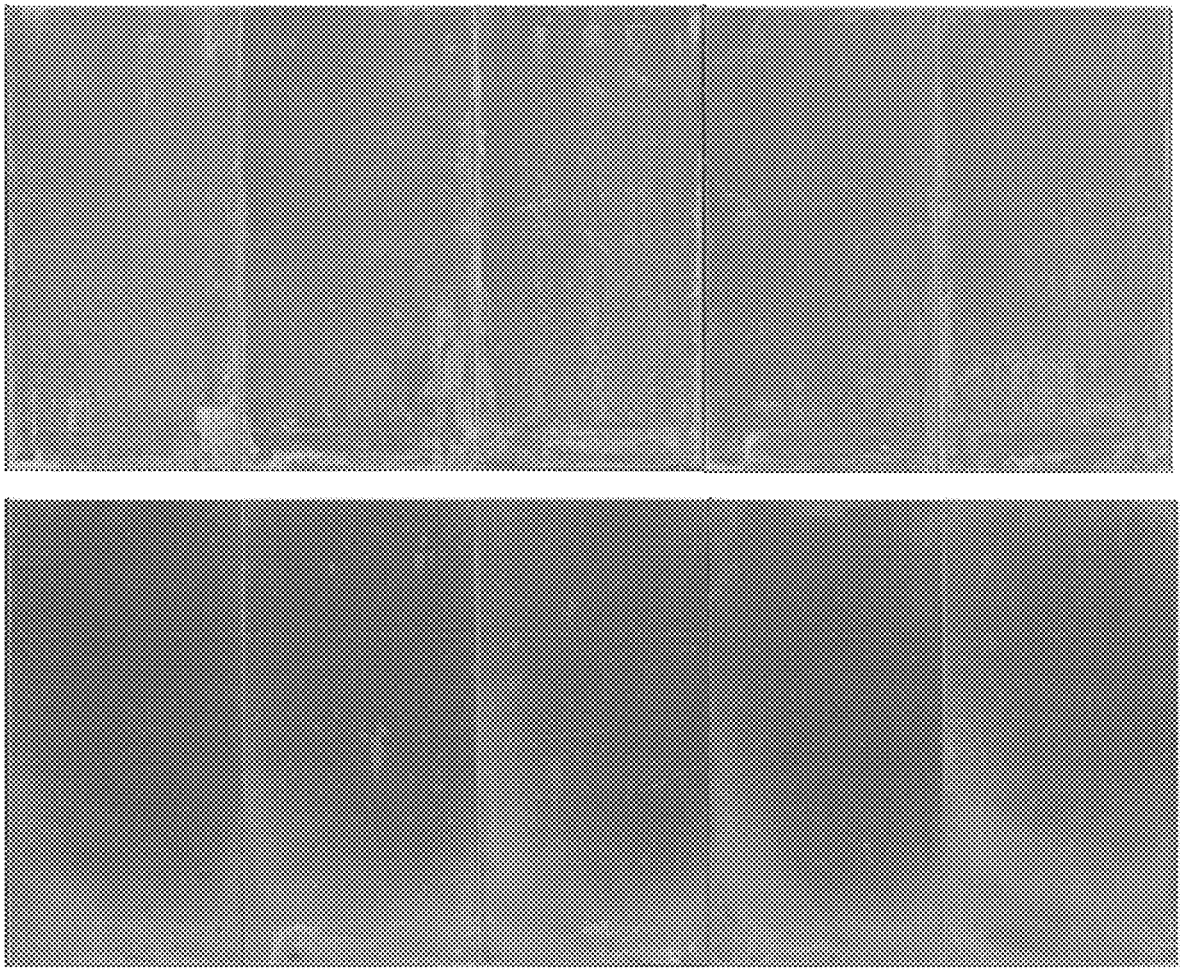
FIG. 4 shows the performance of the invention similar to FIG. 1 except with a chemical dye (Chemeon CC600) used in the conversion coating bath. The impressed current for these panels was 0.3 amps per square foot with the 2024-T3 as the cathode. Panel exposure to ASTMB117 was 5 weeks.

Purpose: To evaluate the performance on an electrodeposited trivalent chromium conversion coating with a dye additive. FIG. 4 shows ASTM B117 corrosion results for a diffusion-controlled (top, control) versus electrodeposited (bottom, experimental) SurTec 650 trivalent chromium conversion coating. The panels on the bottom were processed in a solution that contained dye. The dyed impressed current panels outperformed the control, dye-free panels, as well as dyed control panels. Panels processed 18 Jun. 2018.

TABLE 4

| Date | Current (ASF) | Polarity | Coating Weight (mg/s · ft) |
|---|---|---|---|
| 18 JUN. 2018 | 0 | | 25.6 |
| 18 JUN. 2018 | 0-3 | Cathodic | 56.3 |

Table 4 shows the effect of cathodic impressed-current in a dyed Cr(III) conversion coating solution on the coating weight. The coating weight at 0-3 ASF applied current is 105% greater than the control (AA2024-T3).

Example 5

Figure 5:
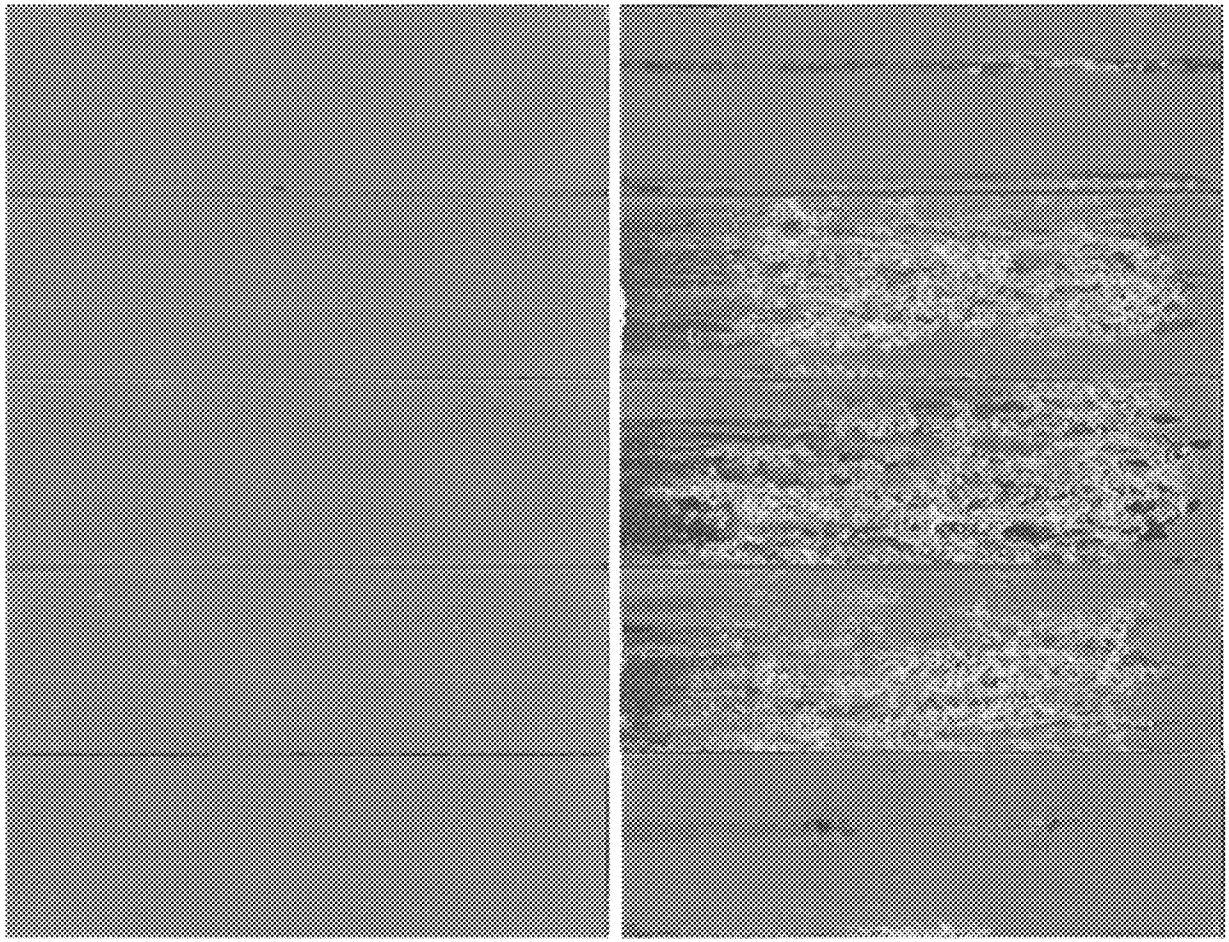
FIG. 5 shows the performance of the invention on AA2219-T87 aluminum, which has about 5% copper and is very prone to corrosion pitting. The figure shows the performance of the invention (bottom row of panels) compared the control (top row of panels), without impressed current after 4 weeks of exposure in ASTM B117 salt fog. The controls were treated in Surtec 650 for five minutes. The invention was also treated in Surtec 650 for five minutes, but also had 0-3 amps per square foot current applied, with the aluminum panels as the cathode. The anode was AA1100 aluminum panels.

Purpose: To evaluate the performance of an electrodeposited trivalent chromium conversion coating on a copper-rich alloy, AA2219-T87. FIG. 5 shows ASTM B117 corrosion results for a diffusion-controlled (top, control) versus electrodeposited (bottom, experimental) SurTec 650 trivalent chromium conversion coating. The unique result of this experiment was the extended resistance to pitting. Typically, panels of this alloy last less than three days, and in this test, 4-5 weeks was achieved. The panels were processed on 16 Aug. 2018.

TABLE 5

| DATE | Current (ASF) | Polarity | Coating Weight (mg/s · ft) |
|---|---|---|---|
| 16 AUG. 2018 | 0 | | 12.8 |
| 16 AUG. 2018 | 0-3 | Cathodic | 52.2 |

Table 5 shows the effect of cathodic impressed current in a Cr(III) conversion coating solution on the coating weight. The coating weight at 0-3 ASF applied current is 308% greater than the control (AA2219-T87).

Example 6

Figure 6:
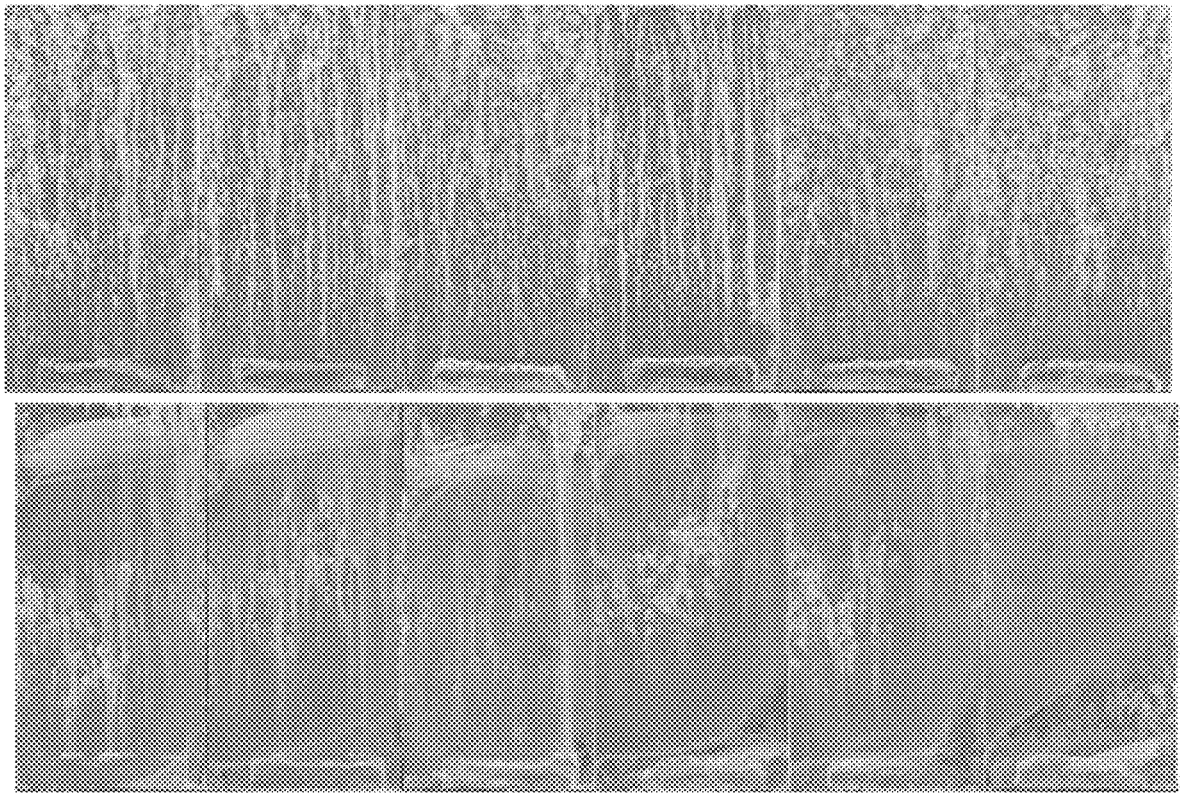
FIG. 6 shows the performance of the invention using a non-chromium commercial product, Bonderite 5200. The invention (bottom row of panels) is compared the control (top row of panels), without impressed current after 4 days of exposure in ASTM B117 salt fog. The test panels are AA2024-T3 aluminum. The controls were treated in Bonderite 5200 for 10 minutes. The invention was also treated in Bonderite 5200 for 10 minutes, but also had 0-3 amps per square foot current applied, with the aluminum panels as the cathode.

Purpose: To evaluate the performance of an electrodeposited non-chromium conversion coating. FIG. 6 shows ASTM B117 corrosion results for a diffusion-controlled (top, control) versus electrodeposited (bottom, experimental) Bonderite 5200 non-chromium conversion coating. The panels were processed on 12 Sep. 2018.

TABLE 6

| Date | Current (ASF) | Polarity | Coating Weight (mg/s · ft) |
|---|---|---|---|
| 12 SEP. 2018 | 0 | | 56.2 |
| 12 SEP. 2018 | 0-3 | Cathodic | 69.4 |

Table 6 shows the effect of cathodic impressed current in a non-chrome conversion coating on the coating weight. This experiment was conducted with a 10-minute immersion time. The coating weight at an applied current of 0-3 ASF is 21% greater than the control.

Example 7

Purpose: To evaluate the performance of an electrodeposited trivalent chromium conversion coating from a non-commercial conversion coating bath, TCP-S. For this example, a conversion coating bath was made using 3.0 grams per liter chromium sulfate basic, 4.0 grams per liter potassium hexafluorozirconate and 0.12 grams per liter potassium tetrafluoroborate. The composition and use of TCP-S is documented in U.S. Pat. No. 6,511,532 and others as awarded to the United States Navy. Test panels of AA2024-T3 aluminum were first immersion cleaned in Bonderite C-AK 6849 (an alkaline cleaner), rinsed in hot tap water, immersion treated in Bonderite C-IC (a ferric sulfate based deoxidizer), rinses in cold tap water, and then processed in the composition described above either with or without applied current. After the conversion coating step, panels were immersion cleaned in cold tap water followed by a final deionized water spray rinse, and allowed to air dry in the lab for 12 hours.

Figure 7:
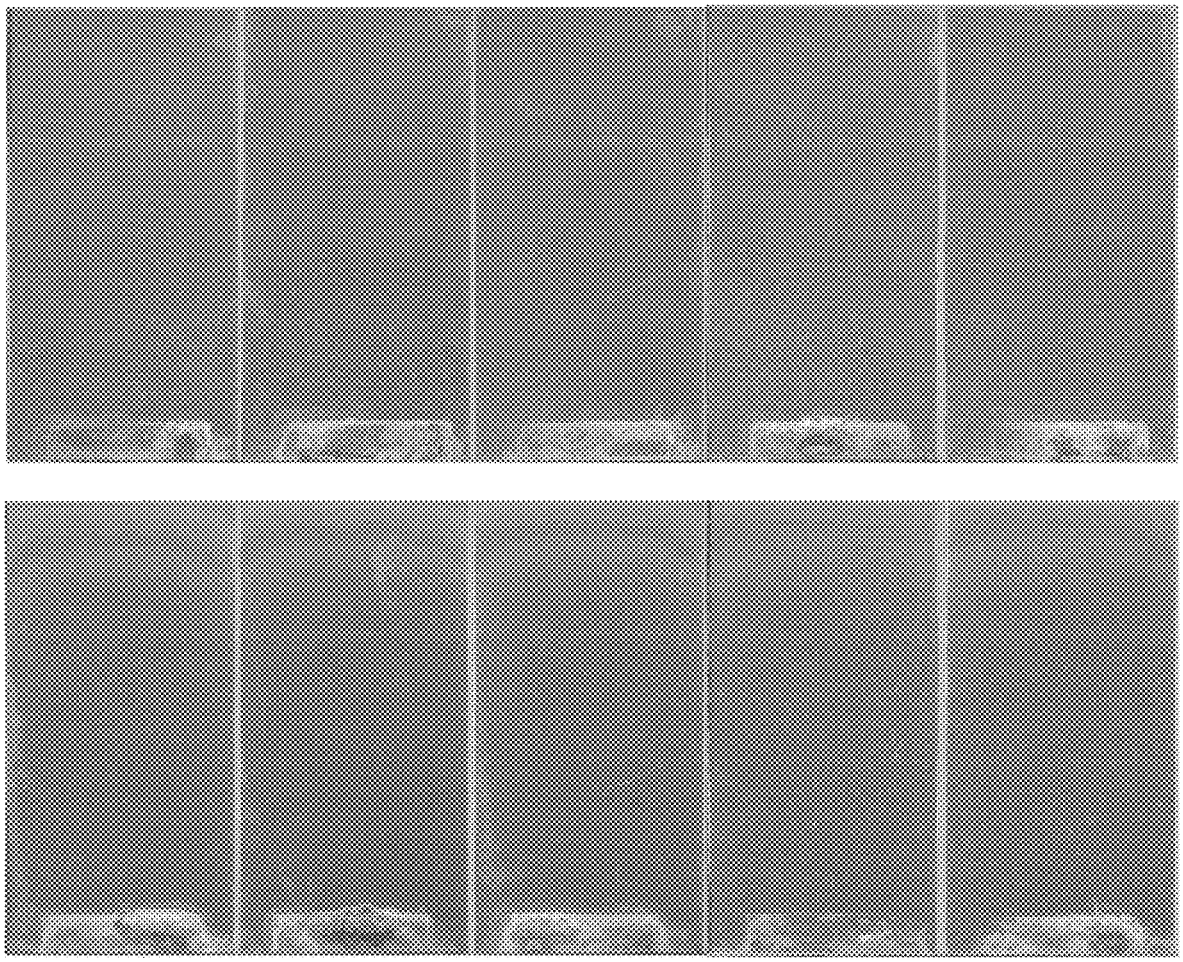
FIG. 7 shows the performance of the invention (bottom row of panels) compared the control (top row of panels), without impressed current after 3 weeks of exposure in ASTM B117 salt fog. The test panels are AA2024-T3 aluminum. The controls were treated in TCP-S (non-commercial product) for five minutes. The invention was also treated in TCP-S for five minutes, but also had 0-3 amps per square foot current applied, with the AA2024-T3 panels as the cathode. The anode was AA1100 aluminum panels.

The performance of coatings made using the impressed current process compared to standard conversion coating are shown in FIG. 7 and Table 7, which shows the number of corrosion pits visible on each panel after each test interval. From the figure and pitting data in the table, it is clear that the invention provides a significant increase in corrosion performance over the control. Table 8 shows coating weights for the control and invention. The invention shows a 22% higher coating weight than the control, which is consistent with performance from the commercial products described in prior examples.

TABLE 7

| | Control Panels | | | | | Impressed Current | | | | |
|---|---|---|---|---|---|---|---|---|---|---|
| Panel # | 1 | 2 | 3 | 4 | 5 | 1 | 2 | 3 | 4 | 5 |
| 336 hrs | 0 | 2 | 0 | 0 | 10 | 1 | 1 | 0 | 0 | 0 |
| 456 hrs | 8 | 45 | 14 | 86 | 23 | 0 | 1 | 0 | 0 | 1 |
| 504 hrs | 104 | 89 | 36 | 200+ | 78 | 3 | 2 | 3 | 37 | 5 |

TABLE 8

| Date | Current (ASF) | Polarity | Coating Weight (mg/s · ft) |
|---|---|---|---|
| 25 SEP. 2019 | 0 | | 37.2 |
| 25 SEP. 2019 | 0-3 | Cathodic | 45.4 |

Example 8

Electrical Contact Resistance Data

Electrical resistance data collected in accordance with MIL-DTL-81706 indicates that the electrodeposited coating does not exceed the maximum limit of 5000 μOhm PSI for Class III Coatings.

| | Control, 5 min SurTec 650 | Impressed Current, 5 min SurTec 650 at 0-3 ASF | Impressed Current 10 min SurTec 650 at 0-3 ASF |
|---|---|---|---|
| Electrical Contact Resistance (uOhm PSI) | 735 ± 344 uOhm PSI | 513 ± 157 uOhm PSI | 609 ± 229 uOhm PSI |

Example 9

Paint Adhesion Test Data

Figure 8:
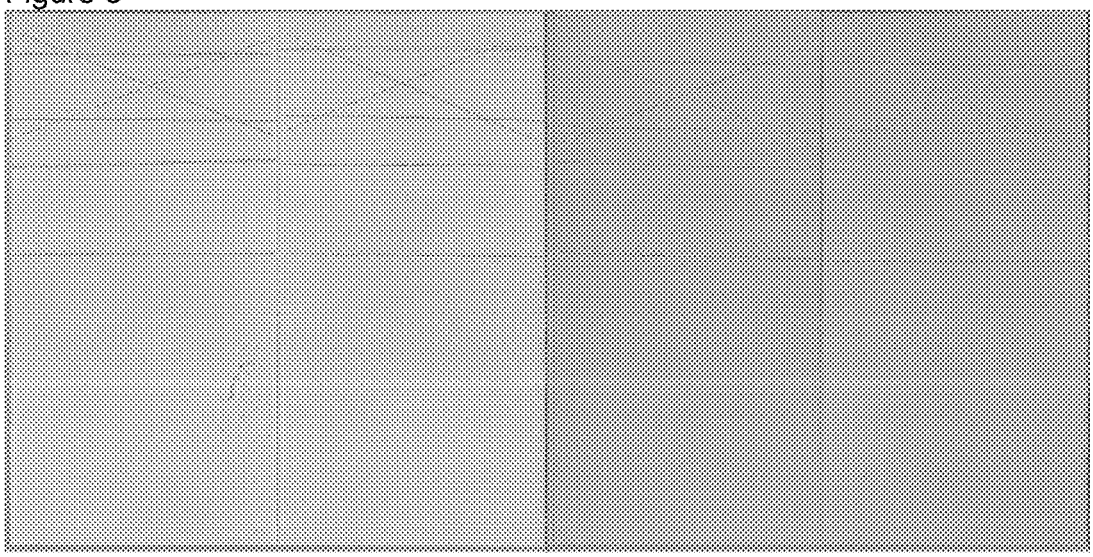
FIG. 8 shows the performance of the control related to paint adhesion, which is another important performance requirement for conversion coatings.
Figure 9:
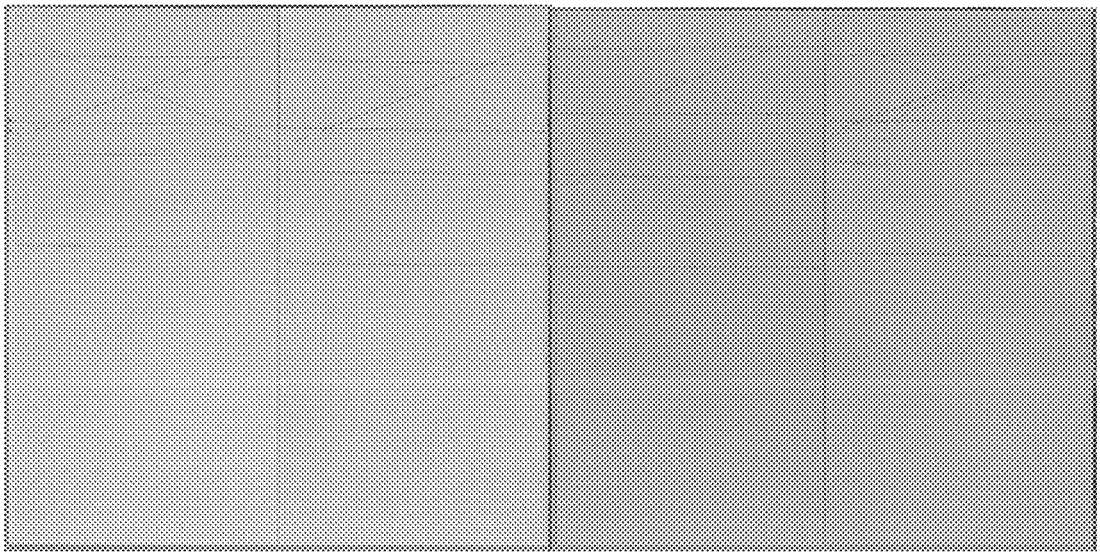
FIG. 9 shows the performance of the invention related to paint adhesion. The results for both are "5A" which means no adhesion degradation.

FIGS. 8 and 9 show the results of paint adhesion testing of the control conversion coating and invention. For this experiment, the conversion coatings were applied per Example 1 and then painted with corrosion-resistant primers which are qualified to MIL-PRF-23377 (left two panels in each figure) and MIL-PRF-85582 (right two panels in each figure). Adhesion results show no degradation in performance for the invention compared to the control.

In summary, the data show that the electrodeposited conversion coatings achieve excellent corrosion resistance without the use of hexavalent chromium. This is in line with United States Navy and international initiatives to eliminate the use of hexavalent chromium. The process enables the deposition of a conversion coating on several series of aluminum alloys, a titanium alloy and silver and improves the corrosion resistance of difficult-to-protect aluminum alloys by up to 200-300% as determined by accelerated corrosion testing in neutral salt fog (ASTM B117). Moreover, the process allows the user to select a desired coating weight through the adjustment of cathodic current density and amp-hours and provides a shorter immersion with a high-current density to produce a thicker coating than the diffusion-controlled process with heavier coating weights. The process allows for a scalable coating weight between 2-7× the average coating weight for a typical diffusion-controlled immersion process. The resultant thicker coatings are stable, lack the "powdery" appearance of thicker-coatings achieved using the current art, and perform well in neutral salt fog exposure.

The electrolytic process of this invention also allows the user to dope existing conversion coating solutions with organic dyes to achieve highly visible, easily-detectable conversion coatings without significant loss in performance. The addition of organic dyes to a standard, diffusion-controlled process typically results in corrosion performance degradation. Aluminum alloys treated with the electrolytic process of this invention develops a slight opacity that provides improved contrast for the detection of localized corrosion. Easier detection of corrosion allows system maintainers to readily find and treat problem areas. The electrolytic process also works well on abraded surfaces. Corrosion performance of simulated rework surfaces suggested that the electrolytic process out performs diffusion-controlled processes and complements the technological transition of the aerospace industry to non-hexavalent chromium replacements with simple modifications to conversion coating facilities.

While this invention has been described by a number of specific examples, it is obvious that there are other variations and modifications which can be made without departing from the spirit and scope of the invention as particularly set forth in the appended claims.

The invention claimed is:

1. Process for coating a metal surface by passing an electric current through a trivalent chromium conversion-coating electrolyte at the cathodic or anodic metal, said current having a density not exceeding 3.0 amperes per square foot for a duration less than 60 minutes, wherein the trivalent chromium conversion-coating electrolyte consists of chromium sulfate, metal hexafluorozirconate and metal tetrafluoroborate.

2. The process of claim 1, wherein the metal is aluminum or aluminum alloy.

3. The process of claim 1, wherein the metal is either the anode or cathode.

4. The process of claim 1, wherein the current density is less than 3.0 amperes per square foot and the duration of time is less than 60 minutes.

* * * * *